United States Patent [19]

Ströle et al.

[11] Patent Number: 4,634,008

[45] Date of Patent: Jan. 6, 1987

[54] CONTAINER MADE OUT OF A FLAT MATERIAL LIKE PAPER, CARDBOARD, ETC. WITH A RIDGED-SEAM CLOSURE, ESPECIALLY A PARALLELEPIPEDAL CONTAINER FOR LIQUID AND MADE OUT OF PAPER, PLASTIC OR COMPOSITE

[76] Inventors: Ulrich Ströle, Land Str. 63, 5177 Titz; Jürgen Färber, Am Hagelkreuz 8, 4044 Kaarst; Arnold Tholen, Alte Schmiede 97, 5138 Heinsberg, all of Fed. Rep. of Germany

[21] Appl. No.: 796,498

[22] Filed: Nov. 8, 1985

Related U.S. Application Data

[63] Continuation of Ser. No. 570,137, Jan. 12, 1984, abandoned.

[30] Foreign Application Priority Data

Jan. 14, 1983 [DE] Fed. Rep. of Germany ..... 3301086

[51] Int. Cl.[4] ..... B65D 5/70

[52] U.S. Cl. ..... 206/628; 206/620; 229/17 R; 493/84; 493/377

[58] Field of Search ..... 229/7 R, 17 R, 17 G, 229/DIG. 5; 206/611, 622, 629, 610, 604, 612, 620, 628; 220/269, 270; 493/84, 297, 377

[56] References Cited

U.S. PATENT DOCUMENTS

| | | | |
|---|---|---|---|
| 402,882 | 5/1889 | Ams | 220/220 |
| 714,816 | 12/1902 | McMullan | 206/604 |
| 1,217,820 | 2/1917 | Peterson | 206/620 X |
| 2,112,013 | 3/1938 | Chalmers | 206/604 X |
| 2,241,836 | 5/1941 | Wentz | 229/17 G |
| 2,283,102 | 5/1942 | Stephano | 206/628 |
| 2,305,631 | 12/1942 | Moore | 229/7 R |
| 2,923,404 | 2/1960 | Adell | 206/612 X |
| 2,983,430 | 5/1961 | Taylor | 206/610 |
| 3,069,066 | 12/1962 | Peckham | 206/620 X |
| 3,074,610 | 1/1963 | Pugh | 206/628 X |
| 3,232,514 | 2/1966 | Swede et al. | 229/17 R |
| 3,301,458 | 1/1967 | Rawsing et al. | 229/7 R |
| 3,520,464 | 7/1970 | Pugh, Sr. | 229/17 G |
| 3,797,726 | 3/1974 | Reil | 229/7 R X |
| 3,957,180 | 5/1976 | Skillman | 229/7 R X |
| 4,066,167 | 1/1978 | Hanna et al. | 206/629 X |
| 4,301,927 | 11/1981 | Carlsson et al. | 229/17 R X |
| 4,362,245 | 12/1982 | Kuchenbecker | 206/628 X |
| 4,428,485 | 1/1984 | Egli | 206/604 |
| 4,441,613 | 4/1984 | Hain et al. | 206/628 X |

FOREIGN PATENT DOCUMENTS

| | | | |
|---|---|---|---|
| 2329518 | 5/1977 | France | 229/17 R |
| 1078901 | 8/1967 | United Kingdom | 229/7 R |

*Primary Examiner*—William Price
*Assistant Examiner*—Gary E. Elkins
*Attorney, Agent, or Firm*—Sprung Horn Kramer & Woods

[57] ABSTRACT

To facilitate manual opening of a container made out of a flat material like paper, cardboard, etc. with a ridged-seam closure, and especially a parallelepipedal container for liquid and made out of paper, plastic, or composite, at least one tear-off flap is attached to the outside of the ridged-seam closure like a tab. To facilitate in particular the opening of containers with earfolds, perforations are provided in the vicinity of the triangular folds to generate a smooth tear when the container is opened and produce a clean opening that will ensure trouble-free pouring.

10 Claims, 8 Drawing Figures

CONTAINER MADE OUT OF A FLAT MATERIAL LIKE PAPER, CARDBOARD, ETC. WITH A RIDGED-SEAM CLOSURE, ESPECIALLY A PARALLELEPIPEDAL CONTAINER FOR LIQUID AND MADE OUT OF PAPER, PLASTIC OR COMPOSITE

This application is a continuation of application Ser. No. 570,137, filed Jan. 12, 1984, now abandoned.

BACKGROUND OF THE INVENTION

The present invention relates to a container made out of a flat material like paper, cardboard, etc. with a ridged-seam closure, and especially to a parallelepipedal container for liquid and made out of paper, plastic, or composite.

Containers of this type, especially parallelepipedal containers for liquids are manufactured from both blanks and webs and shaped so that an opening can be cut with scissors in the vicinity of the sealed seam on the top to form a pouring spout. A container of this type with an upper folded section incorporating outside triangular folds is known from German Patent No. 1 298 929 for example. The problem of opening containers of this type has not yet been satisfactorily solved. The container described in the aforesaid patent has a perforated line in the vicinity of the triangular folds to facilitate opening. The composite commonly employed in aseptic containers, however, may consist not only of aluminum foil but also of tough plastic, and tearing a line perforated in this type of material is so difficult that a lot of strength must be employed to rip part of the seam along the perforations. Although it is of course possible in principle to make the perforations deeper in order to facilitate tearing, this is impossible with aseptic containers because the possibility of impairing tightness is not inconsiderable.

SUMMARY OF THE INVENTION

The object of the present invention is a container made out of a flat material like paper, cardboard, etc. with a ridged-seam closure, and especially to a parallelepipedal container for liquid and made out of paper, plastic, or composite that is especially easy to open by hand.

This object is attained in accordance with the invention with at least one tear-off flap attached to the outside of the ridged-seam closure like a tab. The tab-like design of the tear-off flap results in a comparatively extensive easily grasped area that allows the ridged-seam closure to be torn and the container opened without auxiliary means.

In one special embodiment of the invention the tear-off flap has one element that attaches it to the ridged-seam closure and another that projects beyond the free terminal edge of the container facing away from the base line of the ridged-seam closure on the side of the container.

When the top of the container is folded, the tear-off flap extends at least over the area covered by one of the triangular folds that are at the ends of the centrally located upper seam and can be positioned against the side wall of the container. Augmented tension can be exerted by means of the flap in the vicinity of the seam and of the base of the triangle. The container can then be opened manually in two steps, first by tilting the triangular fold up with the seam held vertically, ripping into the seam across its length, and then pulling off the ripped-into or ripped-off part of the seam with the tear-off flap so that the particular part of the seam rips off along with part of the triangular folds.

The method of opening the container just described can be essentially facilitated if the container is made in the form of a folded box from a scored blank or flattened surface and if the inner longitudinal edge of the tear-off flap, which extends essentially across the ridged-seam closure, is adjacent to a scored line extending along the container at the base of the triangular fold. In this case the line of tear will pass through the scored line.

Pulling off and ripping into the ridged-seam closure with part of the triangular fold can be facilitated with a perforated line on both sides of the seam that parallels the direction of the fibers that the material is made out of so that the fibrous structure will augment the weakening action of the line. This results in an essentially smoother tear that produces a more uniform pouring spout.

The shape, size, and material of the tear-off flap can vary. It is preferably cemented, bonded, heat-bonded, or stapled to the outside of the ridged-seam closure. It is also practical to attach the flap to the closure in one layer from one side or in two layers from two sides.

In this case the tear-off flap should extend not only in the vicinity of the triangular fold but also beyond, with the inner longitudinal edge of the flap positioned in the vicinity of a notch, perforation, incision, or similar structure in the closure. This will result in a comparatively large pouring opening when the flap is bent down and the upper seam and part of the triangular fold subsequently ripped off, entailing not only the advantage that air can penetrate into the container but also facilitating pouring out viscous contents for example.

Finally, the tear-off flap can have a longitudinal slit in the vicinity of the scored line or consist of two separate flap elements with the line that separates them located on the scored line. The first element can be used for fastening and the other for tearing off, and the former can later be employed to complete the opening of a container by ripping apart the total ridged-seam closure along a perforated line. When there are two flap elements it is preferable for the scored line to be left uncovered rather than covered. This makes it easier to apply the triangular fold to the wall.

When the ridged-seam closure is in the middle of the container it is practical for the ridged-seam closure not to exceed a certain size. Although it must of course be large enough to be easily gripped with the fingers in order to facilitate opening the container, it should not extend laterally beyond the container when the triangular folds rest against the wall. It is practical for the flap to be about half as high as the container is wide. This ensures that, when the triangular folds rest against the outside of the container, the flap will always remain within the contours of the container to prevent affecting such further stages of the operation as packing and shipping.

The shape and material of the tear-off flap can be selected to essentially increase its hold. Expansions, depressions, roughening, non-slip coatings etc. can essentially improve the grip, especially if the flap is a loop into which a finger can be inserted to rip open the container.

The material that the tear-off flap is made out of should be relatively stiff and resistant to tear in accordance with application. Fibrous materials like paper, cardboard, woven or non-woven fabric, or thermoplastic-coated fiber that are amenable to cementing are appropriate. Their high tear resistance also makes fibrous materials with inlaid thread or textiles appropriate. Finally, plastic or composite film can also be used when highly tear-resistant.

The most practical material for containers intended for liquids is a moisture-resistant material, especially when they are to be filled with products that are to be kept in a cold chain, when it becomes necessary to avoid weakening the material with condensation.

Of course the surface of the tear-off flap can be employed for opening instructions, dates, etc. Varying advertising copy is also conceivable.

When the tear-off flap is attached to the upper seam is not essential. It is conceivable in principle for the flap to be part of the blank, in one piece with the container, that is, when the containers are folded up from blanks. This will, however, increase the costs of material or material losses as the result of waste scraps, and the cost will increase with the height of the flap. There are many ways of attaching the tear-off flap. It can for example be attached to a container that is open at the top before the contents are poured in. When the containers are aseptic, however, it is practical to apply the flap later, in which case the container can be manufactured from a conventional blank, filled, and sealed. This will prevent affecting the tightness and sterility of the filled container if there are any defects in the flap, retaining the complete quality and life of the product.

Some preferred embodiments of the invention will now be described with reference to the accompanying drawings, wherein

DETAILED DESCRIPTION OF THE PREFERRED EMBODIMENTS

Figure 1:
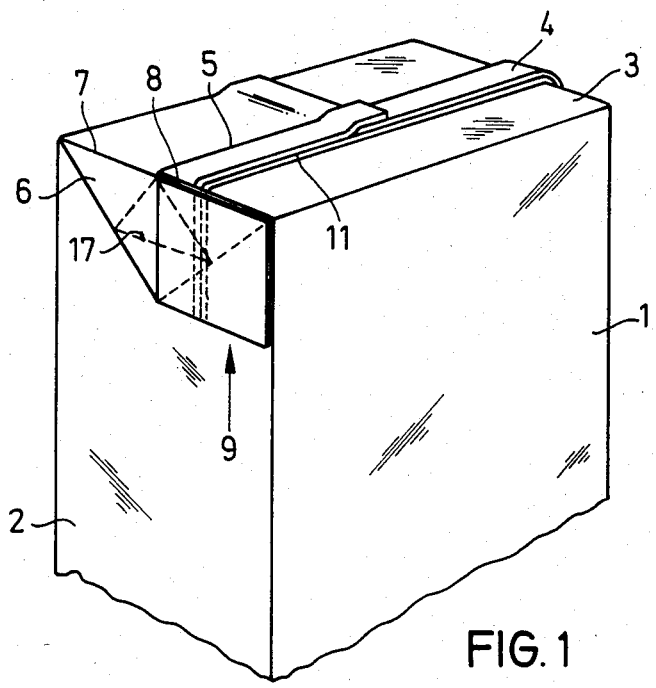
FIG. 1 is a perspective view of an unopened container with a tear-off flap attached to the continuous ridged-seam closure.

The package illustrated in FIG. 1 has four side walls, only two of which, a front wall 1 and a side wall 2, are shown. The container is made for example out of plastic-coated cardboard blank with aluminum foil inside. The blank has longitudinal and transverse scored lines that constitute the edges of the finished container.

Once it has been filled, the top of the container is closed along a ridged-seam closure 4 that rests above a base line 5 on the upper wall 3. At the ends of ridged-seam closure 4 are triangular folds 6, of which the only one illustrated in FIG. 1 is the one on forward-facing side wall 2. Triangular folds 6 are folded down laterally in conjunction with the corresponding ends of ridged-slam closure 4 against the container and attached with an easily released pressure connection to side wall 2. Triangular folds 6 are folded around a side-wall edge 7 that extends into ridged-seam closure 4 and is indicated in FIG. 1 in the form of a scored line 8. A tear-off flap 9 is attached between scored line 8 and the free end of ridged-seam closure 4. Flap 9 is square in the embodiment in FIG. 1, with one side about half as long as triangular folds 6 or the container are wide. Tear-off flap 9 accordingly extends outside of the free terminal edge 11 of ridged-seam closure 4, providing, as will be especially evident from FIG. 2, a finger grip 12 and a securing area 13 that attaches tear-off flap 9 to ridged-seam closure 4 by hot bonding, cementing, or a similar method.

To open the container, which may have an air hole 14, tear-off flap 9 is grasped by finger grip 12 and moved in the direction indicated by arrow 15 until it bends around point 16, generating a rip along and coincident with the scored line 8 in ridged-seam closure 4. The part of ridged-seam closure 4 that is located below the securing area 13 of tear-off flap 9 is then torn off, preferably along a perforated line 17 in order to produce a clean pouring opening.

The finger grip 12 of the tear-off flap 9 in the illustrated embodiment has an opening 18. This increases the grip on tear-off flap 9 and prevents it from ripping or makes it more difficult to rip.

If the container is intended for liquid, finger grip 12 is made out of a moisture-resistant material.

The fibers of the material out of which the container is made preferably extend across the the height of the container, parallel, that is, to ridged-seam closure 4. The line of tear will accordingly develop naturally and generate a uniform pouring spout.

Figure 2:
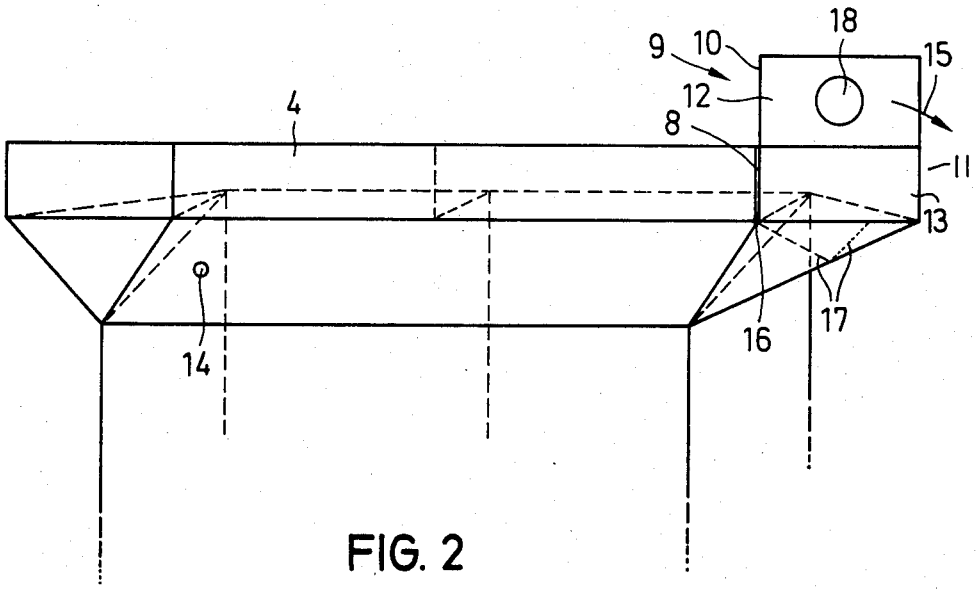
FIG. 2 illustrates the upper part of the container with the ridged-seam closure upright and with a square tear-off flap.
Figure 3:
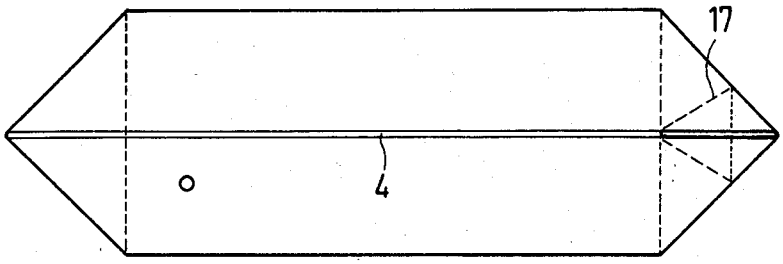
FIG. 3 is a top view of the container in FIG. 2.

Since the tear-off flap 9 in the embodiment illustrated in FIG. 2 is square, it will not project beyond the lateral contour of the container if ridged-seam closure 4 is in the middle and when triangular folds 6 rest against the side.

Figure 4:
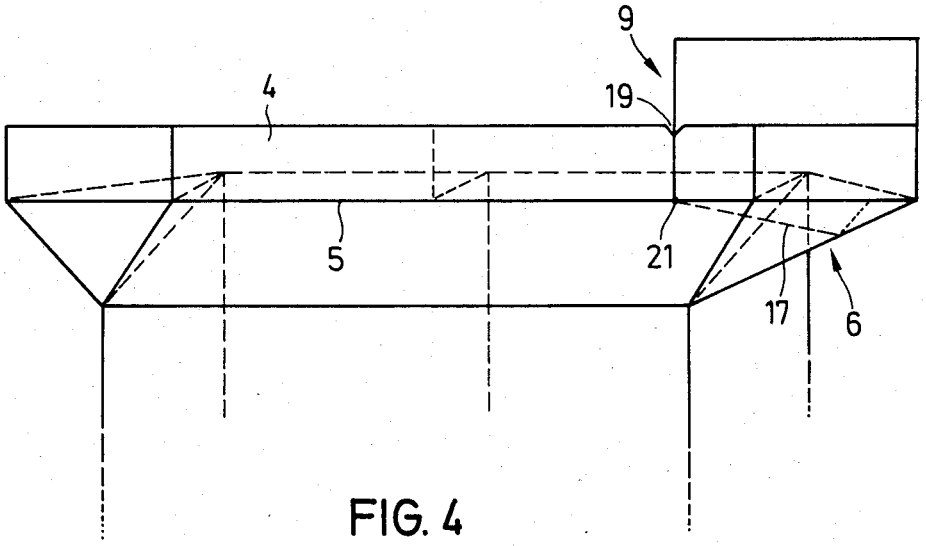
FIG. 4 illustrates another embodiment of a tear-off flap that will produce a larger pour-out opening.
Figure 5:
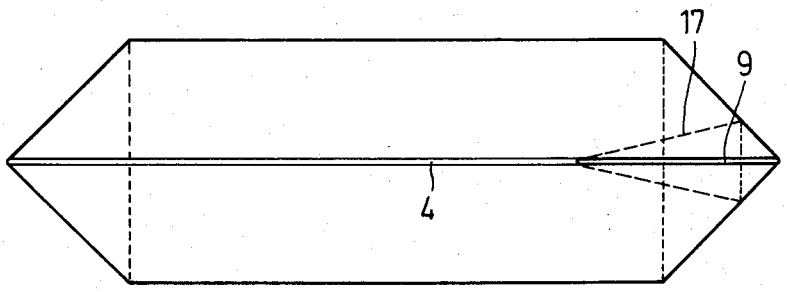
FIG. 5 is a top view of the container in FIG. 4.

In the embodiment illustrated in FIGS. 4 and 5, tear-off flap 9 extends in beyond the area covered by triangular fold 6 to the vicinity of a notch 19 in ridged-seam closure 4. There is also a perforated line 17 that extends from the base line 5 of ridged-seam closure 4 so that ridged-seam closure 4 will be ripped into when tear-off flap 9 is bent down around point 21 starting from notch 19 and the seam or fold will then be ripped into or ripped up along perforated line 17. This method of opening is employed when there is no air hole inside the container, when, that is, comparatively large openings are to be made for the air to enter through.

Figure 6:
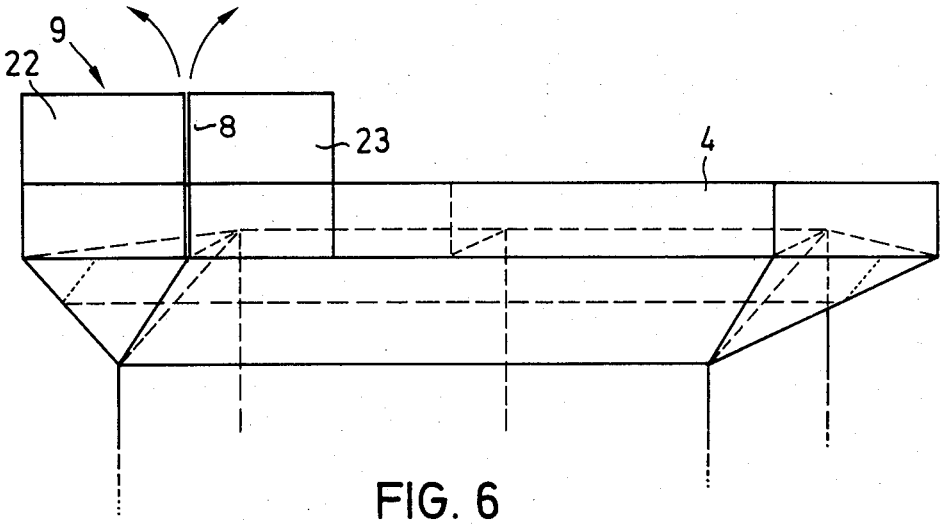
FIG. 6 illustrates still another embodiment with a two-part tear-off flap.
Figure 7:
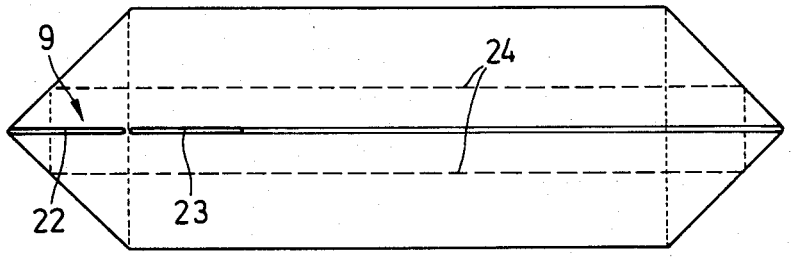
FIG. 7 is a top view of the container of FIG. 6.

FIGS. 6 and 7 illustrate yet another embodiment of the invention in which tear-off flap 9 is in two parts, a flap element 22 and a flap element 23, and in which scored line 8 is not covered up. Flap element 23 is employed to hold the container while it is being opened and flap element 22 to tear ridged-seam closure 4 as described in the foregoing between the two elements to make the opening. Flap element 23 can then be employed to tear open the rest of ridged-seam closure 4 if desired, so that the whole seam will be open and paste-type products can be removed or consumed directly from the container. To facilitate completely opening the container with flap element 23 there is a perforation 24 in the upper wall 3 as illustrated in FIG. 7.

Figure 8:
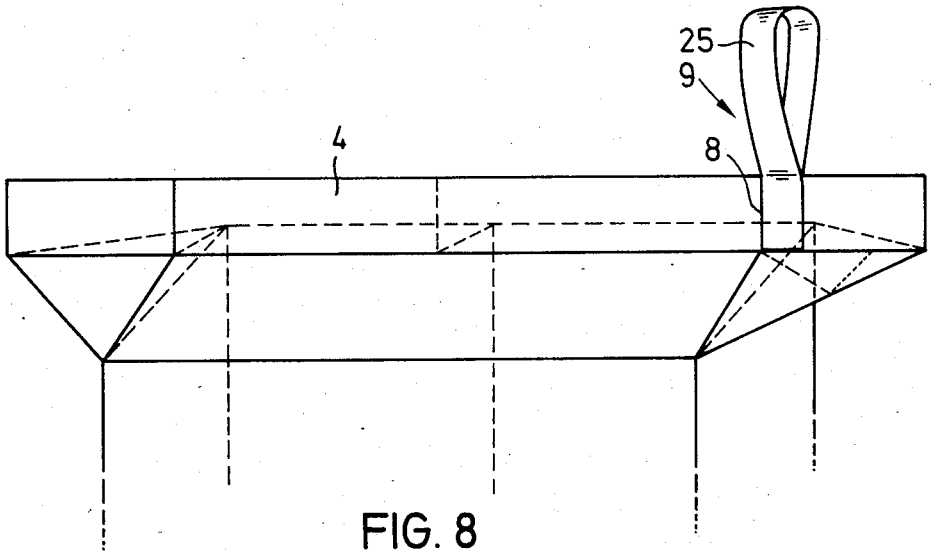
FIG. 8 illustrates still another embodiment of a tear-off flap 9 in the form of a loop.

The tear-off flap 9 in the embodiment illustrated in FIG. 8 is a loop 25 in which a finger can be inserted to rip into the outside of the ridged-seam closure and the associated part of the triangular folds to produce the desired opening. Loop 25 is likewise positioned at the critical point, in the immediate vicinity of the scored line 8 that extends across ridged-seam closure 4, that is.

Tear-off flap 9 can in principle be attached directly to the container blank or even attached to the ridged-seam closure 4 of the still open container before it is filled. When the containers are aseptic, however, it is practical to apply the flap later to prevent affecting the tightness and sterility of the filled container if there are any defects in the flap. The flap can also be attached immediately after the upper seam has been sealed. It is also possible to attach the flap to the closure once the triangular fold is in place against the wall of the container.

The type of opening produced can be controlled to a large extent by varying the format of the flap, the type of attachment, the arrangement of perforations or notches etc. The flaps can be made out of the most appropriate material for the particular field of application, with those intended for containers for liquid being made out of a moisture-resistant material for example. Finally, satisfactory grip can be obtained not by means of an opening 18 but by roughening the surface, by providing elevations, with slip-resistant coatings, etc.

It is understood that the specification and examples are illustrative but not limitative of the present invention and that other embodiments within the spirit and scope of the invention will suggest themselves to those skilled in the art.

We claim:

1. A container comprising: a parallelipedal body made in the form of a folded box from a scored blank or flattened surface with a flat top and composed of a flexible composite sheet material; a ridged-seam closure at the top and extending above a base line on the top of the body to a free terminal edge facing away from the base line; triangular folds at the ends of the ridged seam closure and folded down against side walls of the body with the base of each triangular fold disposed along an upper side wall edge; a tear-off opening flap having a connecting portion attached to the outside of the ridged-seam closure and a gripping portion projecting beyond the terminal edge of the closure and away from the base line of the ridged-seam closure at the side wall of the body and extending over an area covered by one of the triangular folds, wherein the seam closure has a scored line disposed parallel to and over the base of said one of the triangular folds and extending from the base line to the terminal edge of the seam closure and the tear-off flap has an inner longitudinal edge parallel to and coincident with the scored line.

2. A container as in claim 1, wherein the tear-off flap has a longitudinal slit coincident with the scored line.

3. A container according to claim 1, wherein the tear-off flap comprises two side-by-side separate flap elements extending upwardly from the closure with a line separating the two flap elements located on the scored line and with the scored line left uncovered.

4. A container according to claim 1, wherein the tear-off flap is positioned above an area extending on both sides of the ridged-seam closure and wherein the area is provided with perforations.

5. A container according to claim 1, wherein the tear-off flap is cemented, bonded, heat-bonded or stapled to at least one side of the ridged-seam closure.

6. A container according to claim 1, wherein the the ridged-seam closure is in the middle of a side wall of the container and the tear-off flap is rectangular with a side that is not more than half as long as the container is wide.

7. A container according to claim 1, wherein the tear-off flap includes expansions, depressions, roughening, or a non-slip coating to facilitate handling.

8. A container according to claim 1, wherein the flap includes a loop.

9. A container according to claim 1, wherein the tear-off flap is made of a tear-resistant and moisture-resistant material.

10. The method of manufacturing a filled container, comprising folding a scored blank along scored lines to form a container, closing the container along a longitudinal bottom seam, filling the container with a product, forming a ridged closing seam at the top of the container which extends above a base line on the top of the container to a free terminal edge facing away from the base line, folding the ridged closing seam flat down on the top of the container and folding the ends of the ridged closing seam in triangular folds folded down against the sides of the container with the base of each of the triangular folds disposed along an upper side wall edge, forming a scored line on the seam closure parallel to and over the base of one of the triangular folds and extending from the base line of the seam to the terminal edge thereof and attaching a tear-off flap to the outside of the closing top seam with a finger gripping portion projecting beyond the terminal edge and extending over the vicinity of said one triangular fold with an inner longitudinal edge of the tear-off flap disposed parallel to and coincident with said scored line.

* * * * *